US011018434B2

(12) United States Patent
Tsutsumi et al.

(10) Patent No.: US 11,018,434 B2
(45) Date of Patent: May 25, 2021

(54) ANTENNA APPARATUS, AND MANUFACTURING METHOD

(71) Applicant: KABUSHIKI KAISHA TOSHIBA, Minato-ku (JP)

(72) Inventors: Yukako Tsutsumi, Kawasaki (JP); Makoto Higaki, Setagaya (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/816,449

(22) Filed: Mar. 12, 2020

(65) Prior Publication Data

US 2021/0028548 A1 Jan. 28, 2021

(30) Foreign Application Priority Data

Jul. 25, 2019 (JP) ..... JP2019-136852

(51) Int. Cl.

| | |
|---|---|
| ***H01Q 1/38*** | (2006.01) |
| ***H01Q 13/10*** | (2006.01) |
| ***H01Q 1/22*** | (2006.01) |
| *H01Q 1/48* | (2006.01) |

(52) U.S. Cl.

CPC ..... *H01Q 13/10* (2013.01); *H01Q 1/2283* (2013.01); *H01Q 1/48* (2013.01)

(58) Field of Classification Search

CPC ..... H01Q 1/22; H01Q 1/2283; H01Q 1/38; H01Q 1/40; H01Q 1/46; H01Q 1/48; H01Q 13/10; H01Q 9/0407; H01Q 9/065; H01Q 21/065

See application file for complete search history.

(56) References Cited

U.S. PATENT DOCUMENTS 10,461,389 B2 10/2019 Mukai et al.
2010/0090903 A1* 4/2010 Byun ..... H01Q 13/18 343/700 MS

FOREIGN PATENT DOCUMENTS

JP 2002-271133 A 9/2002
JP 2018-029155 A 2/2018

* cited by examiner

*Primary Examiner* — Jimmy T Vu
(74) *Attorney, Agent, or Firm* — Oblon, McClelland, Maier & Neustadt, L.L.P.

(57) ABSTRACT

An antenna apparatus includes a first dielectric substrate including a first surface and a second surface opposite to the first surface, a radiating element located on the first surface or in the first dielectric substrate, a first electrode on the second surface, a first conductor provided through the first dielectric substrate from the first surface to the second surface, to connect electrically the radiating element and the first electrode, a second dielectric substrate including a third surface and a fourth surface opposite to the third surface, an adhesive layer between the second surface and the third surface, a second electrode on the third surface, a first signal line located on the fourth surface or in the second dielectric substrate, and a second conductor provided through the second dielectric substrate from the third surface to the fourth surface, to connect electrically the second electrode and the first signal line.

20 Claims, 25 Drawing Sheets

ANTENNA APPARATUS, AND MANUFACTURING METHOD

CROSS-REFERENCE TO RELATED APPLICATIONS

This application is based upon and claims the benefit of priority from Japanese Patent Application No. 2019-136852, filed on Jul. 25, 2019; the entire contents of which are incorporated herein by reference.

FIELD

Embodiments described herein relate generally to an antenna apparatus and a manufacturing method thereof.

BACKGROUND

An antenna apparatus including a radiating element and a signal line has been developed. Because of the radiating element, a position of the signal line is limited. On the other hand, a lamination antenna apparatus can be built by a build-up method to secure the position of the signal line, but the build-up method is costly. Applicant recognized an antenna apparatus is desired that can reduce a positioning limit of the radiating element and the signal line, and can be manufactured more cheaply than an antenna apparatus made by the build-up method.

DETAILED DESCRIPTION

Figure 1:
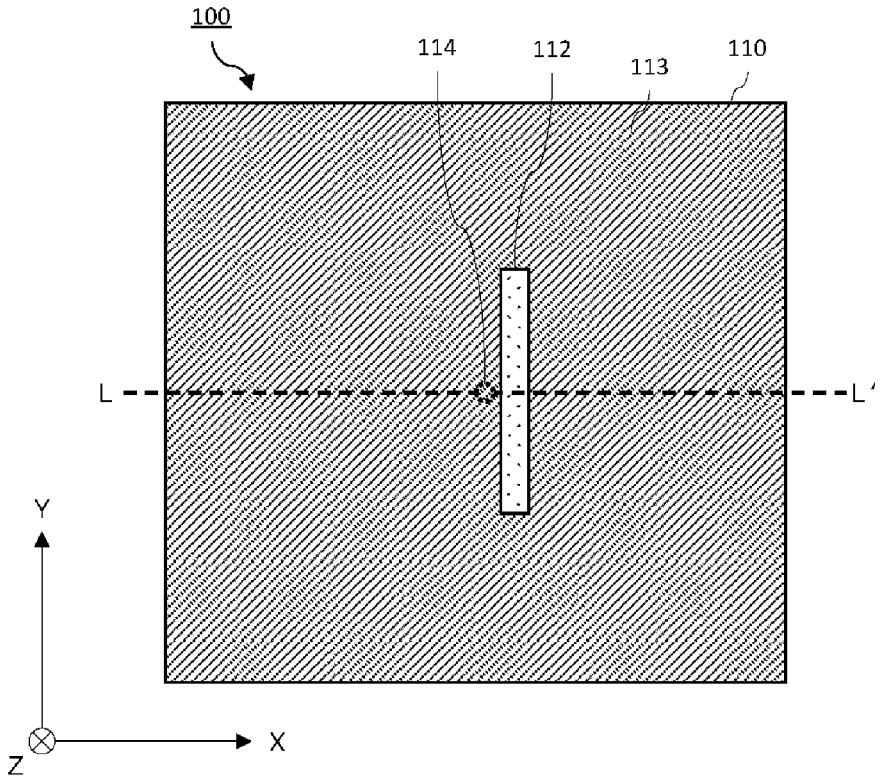
FIG. 1 is a top view of an antenna apparatus 100 according to a first embodiment.

According to one embodiment, an antenna apparatus includes:

a first dielectric substrate including a first surface and a second surface opposite to the first surface;

a radiating element located on the first surface or in the first dielectric substrate;

a first electrode on the second surface;

a first conductor provided through the first dielectric substrate from the first surface to the second surface, to connect electrically the radiating element and the first electrode;

a second dielectric substrate including a third surface and a fourth surface opposite to the third surface;

an adhesive layer between the second surface and the third surface;

a second electrode on the third surface;

a first signal line located on the fourth surface or in the second dielectric substrate; and a second conductor provided through the second dielectric substrate from the third surface to the fourth surface, to connect electrically the second electrode and the first signal line.

Hereinafter, embodiments are described in reference to the drawings. The disclosures are only examples, and the embodiments are not limited by the contents described in the following embodiments. In the drawings, the size, shape, and the like may be schematically represented to make the description more clear. In the multiple drawings, corresponding elements are denoted by the same reference numbers, and detailed descriptions may be omitted.

First Embodiment

Figure 2:
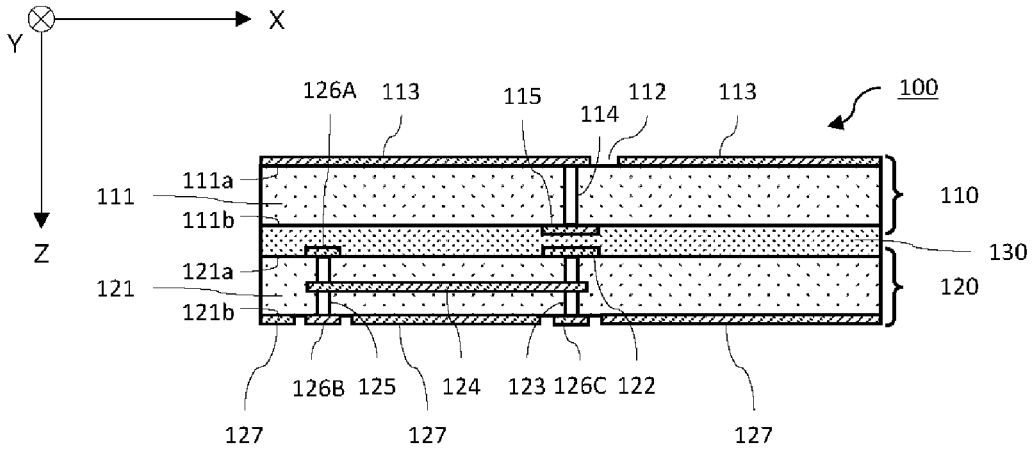
FIG. 2 is a sectional view of the antenna apparatus 100 according to the first embodiment.

Hereinafter, an antenna apparatus 100 of a first embodiment is described. FIG. 1 is a top view of the antenna apparatus 100 (X-Y plane view). FIG. 2 is a sectional view at a broken line L-L' of the FIG. 1 (X-Z plane view). The Z direction described FIG. 1 is a direction going into a page. The Y direction described FIG. 2 is a direction going into the page. Hereinafter, a similar symbol represented by circle and cross is the direction going into the page.

To manufacture the antenna apparatus 100, firstly, a first substrate 110 including a radiating element 112 and a second substrate 120 including a first signal line 124 are separately manufactured. The first substrate 110 and the second substrate 120 are adhered by an adhesive layer 130 to manufacture the antenna apparatus 100. Thereby, the antenna apparatus 100 can be manufactured cheaper than an antenna apparatus made by a build-up method, and the antenna apparatus 100 can reduce a positioning limit of the radiating element 112 and the signal line 124.

The first substrate 110 is described using FIG. 1 and FIG. 2. The first substrate 110 includes a first dielectric substrate 111, the radiating element 112, a first conductive layer 113, a first conductor 114, and a first electrode 115. The radiating element 112 and the first conductive layer 113 are located on an upper surface (−Z direction side surface) of the first dielectric substrate 111. The first conductor 114 is provided through the first dielectric substrate 111 from the upper surface to a lower surface (+Z direction side surface) of the first dielectric substrate 111. The first electrode 115 is located on the lower surface of the first dielectric substrate 111. The radiating element 112 is electrically connected to the first electrode 115 through the first conductor 114.

Hereinafter, "electrically connected" means that a high-frequency signal radiated or received by the radiating element 112 is transmitted in the antenna apparatus 100. "Electrically connected" is not limited to physical connection. For example, if the high-frequency signal is transmitted by electromagnetic coupling, then it is included in "electrically connected".

The first dielectric substrate 111 is an insulator, for example a resin substrate such as PTFE (polytetrafluoroethylene) and epoxy, a form plastic formed with resin, a film substrate such as liquid crystal polymer. In FIG. 2, the upper surface of the first dielectric substrate 111 is described as a first surface 111*a*, the lower surface of the first dielectric substrate 111 is described as a second surface 111*b*.

The radiating element 112 radiates a signal as an electromagnetic wave from the first signal line 124 described later, or receives a signal as the electromagnetic wave to transmit to the first signal line 124. The radiating element 112 as an example is described as a slot antenna. The first conductive layer 113 has the slot (the radiating element 112), and the radiating element 112 can radiate or receive the signal. The radiating element 112 may be another antenna element, for example such as a patch antenna, a monopole antenna, a dipole antenna, an inverted F antenna. The radiating element 112 in a plane view (X-Y plane view) is optional, in the present embodiment, and as an example the radiating element 112 is formed into a rectangle. The radiating element 112 in a plane view may also be formed into such as a polygon, a shape with curves, a shape with multiple connected rectangles and curves. The radiating element 112 is formed in the first conductive layer 113 and electrically connected with the first conductor 114.

The first conductive layer 113 is made of a conductive material, and for example is formed on the first surface 111*a* by patterning. The conductive material is optional, in the present embodiment, and as an example the conductive material is copper. The conductive material may also be such as gold, silver, aluminum, tungsten, and alloys using these metals. The metal may be plated on a surface to prevent rust.

The first conductor 114 connects electrically the radiating element 112 and the first electrode 115 described later, that is, the first conductor 114 transmits and receives a high-frequency signal to and from the radiating element 112. The first conductor 114 is provided through the first dielectric substrate 111 from the first surface 111*a* to the second surface 111*b* (Z direction). In FIG. 1, the first conductor 114 is described in a broken line. The first conductor 114 may be a through hole plated with a conductive material. The first conductor 114 may also be a through hole filled with conductivity filler. The conductivity filler is, for example, epoxy resin, conductive paste.

The first electrode 115 connects electrically the radiating element 112 of the first substrate 110 and the first signal line 124 of the second substrate 120 by connecting electrically with the radiating element 112 through the first conductor 114 and coupling electromagnetically with a second electrode 122 of the second substrate 120 described later. The first electrode 115 of a conductive material may be formed on the first surface 111*b* by patterning. The conductive material is optional, in the present embodiment, and as an example the conductive material is copper. The conductive material may also be such as gold, silver, aluminum, tungsten, and alloys using these metals. The metal may be plated on a surface to prevent rust. The first electrode 115 in a plane view (X-Y plane view) is optional, in the present embodiment, and as an example the first electrode 115 is formed into a round shape. The first electrode 115 in a plane view may also be formed into such as a rectangle, a polygon, a shape with curves, a shape with multiple connected rectangles and curves.

The second substrate 120 is described using FIG. 2. The second substrate 120 includes a second dielectric substrate 121, the second electrode 122, a second conductor 123, the first signal line 124, a third conductor 125, a pad 126A, a pad 126B, a pad 126C, and a second conductive layer 127. The first signal line 124 is located in the second dielectric substrate 121. The second electrode 122 and the pad 126A are located on an upper surface (−Z direction side surface) of the second dielectric substrate 121. The second conductor 123 and the third conductor 125 are provided through the second dielectric substrate 121 from the upper surface to a lower surface (+Z direction side surface) of the second dielectric substrate 121. The first signal line 124 is located in the second substrate 121. The pads 126B, 126C, and the second conductive layer 127 are located on the lower surface of the second dielectric substrate 121. The first signal line 124 connects electrically with the second electrode 122 through the second conductor 123. The first electrode 115 and the second electrode 122 are electromagnetically coupled, and the radiating element 112 and the first signal line 124 are electrically connected.

The second dielectric substrate 121 is an insulator, for example a resin substrate such as PTFE and epoxy, a form plastic formed with resin, a film substrate such as liquid crystal polymer. In FIG. 2, The upper surface of the second dielectric substrate 121 is described as a third surface 121*a*, the lower surface of the second dielectric substrate 121 is described as a fourth surface 121*b*.

The second electrode 122 is electromagnetically coupled with the first electrode 115, and connects electrically the radiating element 112 of the first substrate 110 and the first signal line 124 of the second substrate 120. The second electrode 122 is electrically connected with the first signal line 124 through the second conductor 123 described later. Thereby, the radiating element 112 and the first signal line 124 are electrically connected. The second electrode 122 is a conductive material, and can be formed on the third surface 121*a* by patterning. The conductive material is optional, in the present embodiment, and as an example the conductive material is copper. The conductive material may also be such as gold, silver, aluminum, tungsten, and alloys using these metals. The metal may be plated on a surface to prevent rust. The second electrode 122 in a plane view (X-Y plane view) is optional, in the present embodiment, and as an example the second electrode 122 is formed into a round shape. The second electrode 122 in a plane view may be formed into such as a rectangle, a polygon, a shape with curves, a shape with multiple connected rectangles and curves.

In FIG. 2, the first electrode 115 and the second electrode 122 at least partially face each other in the Z direction across the adhesive layer 130. The first electrode 115 and the second electrode 122 form a capacitor to be electromagnetically coupled. A frequency band of a signal transmitted between the capacitor differs depending on the area where the first electrode 115 and the second electrode 122 face each other in the Z direction. The area corresponds to capacitance of the capacitor. Loss of the signal transmitted between the capacitor is smaller as the area is larger. The area is based on a frequency band of the signal radiated or received by the radiating element and the loss of the signal transmitted between the capacitor. The first electrode 115 and the second electrode 122 may also be directly connected at least partly.

The second conductor 123 connects electrically the second electrode 122 and the first signal line 124 described later. The second conductor 123 is provided through the second dielectric substrate 121 from the third surface 121*a* to the fourth surface 121*b* (Z direction). The second conductor 123 may be a through hole plated with a conductive material. The second conductor 123 may be a through hole filled with a conductivity filler.

The first signal line 124 transmits the signal radiated or received by the radiating element 112. The first signal line 124 is electrically connected to an external electronic apparatus through the third conductor 125 and the pad 126B described later. Examples of the external electronic apparatus are a wireless communication apparatus and a wireless power supply apparatus. The first signal line 124 is electrically connected to the radiating element 112 through the first conductor 114, the first electrode 115, the second electrode 122, and the second conductor 123. The first signal line 124 is electrically connected to the external electronic apparatus through the third conductor 125 and the pad 126B described later. As a result, the antenna apparatus 100 is electrically connected to the external electronic apparatus. The first signal line 124 to transmit is optional, in the present embodiment, and the first signal line 124 may be a microstrip line. The first signal line 124 may also be a strip line and a coplanar line. A mechanism for electrically connecting the antenna apparatus 100 and the external electronic apparatus is not limited to the pad 126B. For example, the first signal line 124 may be extended to a side surface of the second dielectric substrate 121, and may be electrically connected to the external electronic apparatus by solder. The external electronic apparatus may be in the antenna apparatus 100 as an internal electronic apparatus. The internal electronic apparatus may be electrically connected to the first signal line 124.

The third conductor 125 connects electrically the first signal line 124 and the pad 126B described later. The third conductor 125 is provided through the second dielectric substrate 121 from the third surface 121*a* to the fourth surface 121*b* (Z direction). The third conductor 125 may be a through hole plated with a conductive material. The third conductor 125 may be a through hole filled with a conductivity filler.

The pad 126A is located on the third surface 121*a*, and is connected to the third conductor 125. The pads 126B and 126C are located on the fourth surface 121*b*. The pad 126B is connected to the third conductor 125, the pad 126C is connected to the second conductor 123. Hereinafter, the pad 126A, the pad 126B, and the pad 126C may be simply referred to as pads 126. The pad 126B is electrically connected to the external electronic apparatus through a connector (not shown) or a solder (not shown). The pads 126 are of a conductive material, and may be formed on the third surface 121*a* and the fourth surface 121*b* by patterning. The conductive material is optional, in the present embodiment, and as an example the conductive material is copper. The conductive material may also be such as gold, silver, aluminum, tungsten, and alloys using these metals. The metal may be plated on a surface to prevent rust. The pads 126 in a plane view (X-Y plane view) are optional, in the present embodiment, and as an example the pads 126 are formed into a round shape. The pads 126 in a plane view may also be formed into such as a rectangle, a polygon, a shape with curves, a shape with multiple connected rectangles and curves.

The second conductive layer 127 is ground of the antenna apparatus 100, and a shield for preventing transmission of an external electromagnetic wave as noise into the antenna apparatus 100. The second conductive layer 127 is a conductive material, and may be formed on the fourth surface 121*b* by patterning. The conductive material is optional, in the present embodiment, and as an example the conductive material is copper. The conductive material may also be such as gold, silver, aluminum, tungsten, and alloys using these metals. The metal may be plated on a surface to prevent rust.

The pads 126B and 126C may be formed by cutting a part of the second conductive layer 127. As an example of the present embodiment, the second conductive layer 127 is formed by patterning on the fourth surface 121*b*, and a part of the second conductive layer 127 is cut with a blade, a laser, and the like to form the pads 126B and 126C.

The first substrate 110 and the second substrate 120 are described above. The first substrate 110 and the second substrate 120 are adhered by the adhesive layer 130 to manufacture the antenna apparatus 100. The adhesive layer 130 is an optional insulator having low signal loss in transmission, a high filling property, and high adhesion. Examples of the adhesive layer 130 are thermosetting resin, thermoplastic resin, prepreg, and the like.

The configuration of the antenna apparatus 100 is described above. Hereinafter, the operation of the antenna apparatus 100 is described. First, an operation of the antenna apparatus 100 in radiating a signal is described.

A signal to be radiated (hereinafter, also referred to as a radiation signal) from the external electronic apparatus via the pad 126B is input to the antenna apparatus 100. The radiation signal is sent from the pad 126B to the second electrode 122 through the third conductor 125, the first signal line 124, and the second conductor 123. The radiation signal is transmitted from the second electrode 122 to the first electrode 115 by electromagnetic coupling, and is transmitted from the first electrode 115 to the radiating element 112 through the first conductor 114. The radiation signal is radiated by the radiating element 112 as an electromagnetic wave.

An operation of the antenna apparatus 100 in receiving a signal is described. The radiating element 112 receives an electromagnetic wave and outputs a signal representing the electromagnetic wave (hereinafter, also referred to as a reception signal). The reception signal is transmitted from the radiating element 112 to the first electrode 115 through the first conductor 114, and is transmitted from the first electrode 115 to the second electrode 122 by electromagnetic coupling. The reception signal is output from the antenna apparatus 100 to the external electronic apparatus from the second electrode 122 through the second conductor 123, the first signal line 124, the third conductor 125, and the pad 126B.

The operation of the antenna apparatus 100 is described above. Hereinafter, the manufacturing process of the antenna apparatus 100 shown in FIG. 1 and FIG. 2 is described. The antenna apparatus 100 is manufactured by adhering the first substrate 110 and the second substrate 120 by the adhesive layer 130.

A manufacturing process of the first substrate 110 includes a step of forming the first conductive layer 113 on the first surface 111*a*, a step of forming the radiating element 112 on the first surface 111*a*, a step of forming the first electrode 115 on the second surface 111*b*, and a step of forming the first conductor 114 through the first dielectric substrate 111 from the first surface 111*a* to the second surface 111*b* in Z direction. Manufacturing of the first substrate 110 through at least one of these steps is also referred to as preparing the first substrate 110. The preparing the first substrate 110 includes preparing the manufactured first substrate 110.

The manufacturing process of the second substrate 120 includes a step of forming the first signal line 124 in the second dielectric substrate 121, a step of forming the second conductive layer 127 on the fourth surface 121*b*, a step of forming the pads 126B and 126C on the fourth surface 121*b*, a step of forming the second electrode 122 on the third surface 121*a*, a step of forming the pad 126A on the third surface 121*a*, a step of forming the second conductor 123 through the second dielectric substrate 121 from the third surface 121*a* to the fourth surface 121*b* in Z direction, and a step of forming the third conductor 125 through the second dielectric substrate 121 from the third surface 121*a* to the fourth surface 121*b* in Z direction. Manufacturing of the second substrate 120 through at least one of these steps is also referred to as preparing the second substrate 120. The preparing the second substrate 120 includes preparing the manufactured second substrate 120.

The antenna apparatus 100 is manufactured by adhering the first substrate 110 and the second substrate 120 by the adhesive layer 130. At least a part of the first electrode 115 is opposed to at least a part of the second electrode 122. The adhesive layer 130 is located between the first electrode 115 and the second electrode 122.

The antenna apparatus 100 of the present embodiment is described above, variations of the antenna apparatus 100 may be implemented and executed in various ways. Hereinafter, the variations of the antenna apparatus 100 of the present embodiment are described.

The first conductive layer 113, the second conductive layer 127, the first electrode 115, the second electrode 122, and the pad 126 of the present embodiment are not limited to a case in which the copper film is patterned. Optional conductive materials described in the description of the first conductive layer 113, the second conductive layer 127, the first electrode 115, the second electrode 122, and the pad 126 other than copper may be used. The conductive material used for the first conductive layer 113, the second conductive layer 127, the first electrode 115, the second electrode 122, and the pad 126 may be at least partly different. Optional methods other than patterning may be used for forming the first conductive layer 113, the second conductive layer 127, the first electrode 115, the second electrode 122, and the pad 126. For example, a method of adhering the conductive material with an adhesive, a method of welding the conductive material, and the like, may be used.

Figure 3A:
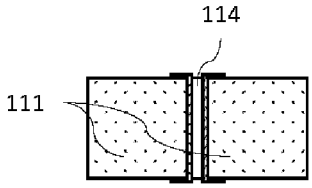
FIG. 3A and FIG. 3B are diagrams illustrating types of a first conductor 114.
Figure 3B:
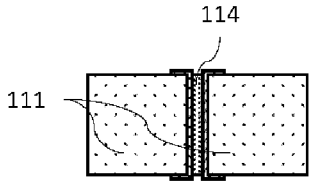

Types of the first conductor 114, the second conductor 123, and the third conductor 125 described in the present embodiment are specifically described with reference to FIG. 3A and FIG. 3B. Although the first conductor 114 is described in FIG. 3A and FIG. 3B as an example for description, the second conductor 123 and the third conductor 125 may be similarly applied. The first conductor 114 may be formed by plating a surface of a through hole with the conductive material as shown in FIG. 3A. As shown in FIG. 3B, the first conductor 114' may be formed by filling a through hole having a plated surface with the conductive filler.

In FIG. 3A and FIG. 3B, a through hole partly filled in the manufacturing process is also included in the range of a conductor. For example, even if a through hole is at least partly filled with the adhesive layer 130, the first conductive layer 113, the second conductive layer 127, the first electrode 115, the second electrode, the pad 126, or the like, the through hole is also included in the range of the conductor.

Hereinafter, variations of the antenna apparatus 100 configuration are described.

(First Variation)

Figure 4:
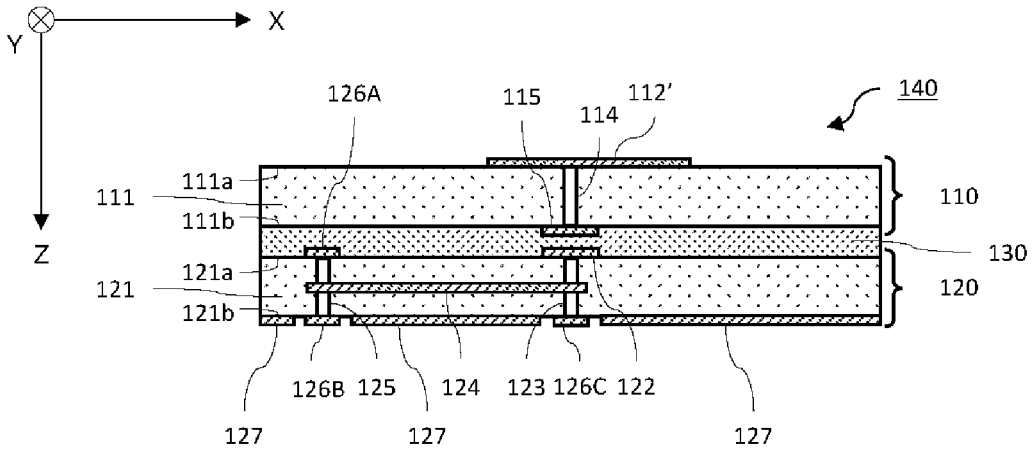
FIG. 4 is a sectional view of an antenna apparatus 140 according to a variation of the first embodiment.

In the description of the antenna apparatus 100, the radiating element 112 is described as a slot antenna, but the radiating element 112 is not limited to a slot antenna. For example, a patch antenna may be used, and FIG. 4 illustrates an antenna apparatus 140 including a patch antenna. FIG. 4 is a sectional view of the antenna apparatus 140, similar to the sectional view at the broken line L-L' of FIG. 1. The radiating element 112' (a patch antenna) is located on the first surface 111*a*. Even if the radiating element 112' is a patch antenna, the radiating element 112' is electrically connected to the first electrode 115 through the first conductor 114 in the first substrate 110.

(Second Variation)

Figure 5:
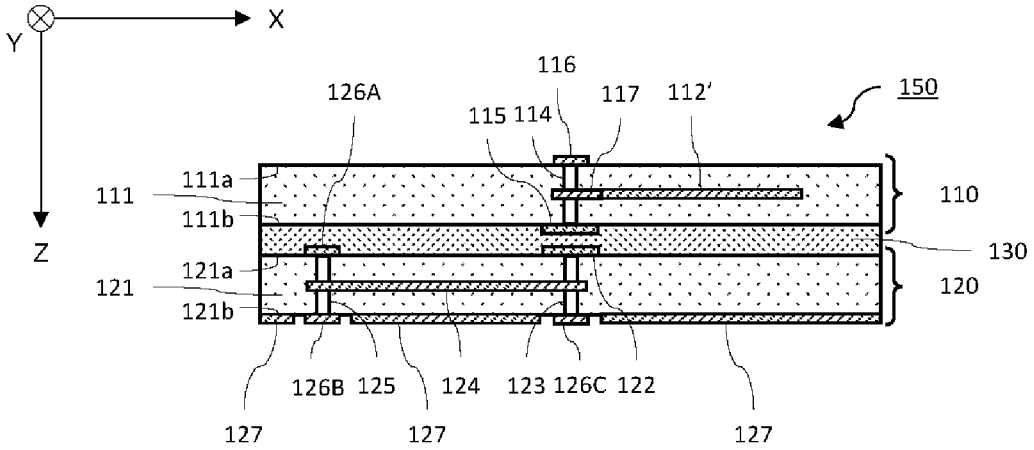
FIG. 5 is a sectional view of an antenna apparatus 150 according to a further variation of the first embodiment.

In the description of the antenna apparatus 100, the radiating element 112 is formed on the first surface 111*a*, the radiating element 112 may be located in the first dielectric substrate 111. FIG. 5 illustrates an antenna apparatus 150 including the radiating element 112' located in the first dielectric substrate 111. FIG. 5 is a sectional view of the antenna apparatus 150, similar to the sectional view at the broken line L-L' of FIG. 1. As an example, the radiating element 112' is illustrated as the patch antenna described in the first variation. In the first substrate 110, the radiating element 112' is electrically connected to the first electrode 115 through a signal line 117 and the first conductor 114. The signal line 117 is an optional line of signal transmission. For example, the signal line 117 may be a strip line, a microstrip line, a coplanar line, or the like. A pad 116 is located on the first surface 111*a*, and connects the first conductor 114.

(Third Variation)

Figure 6:
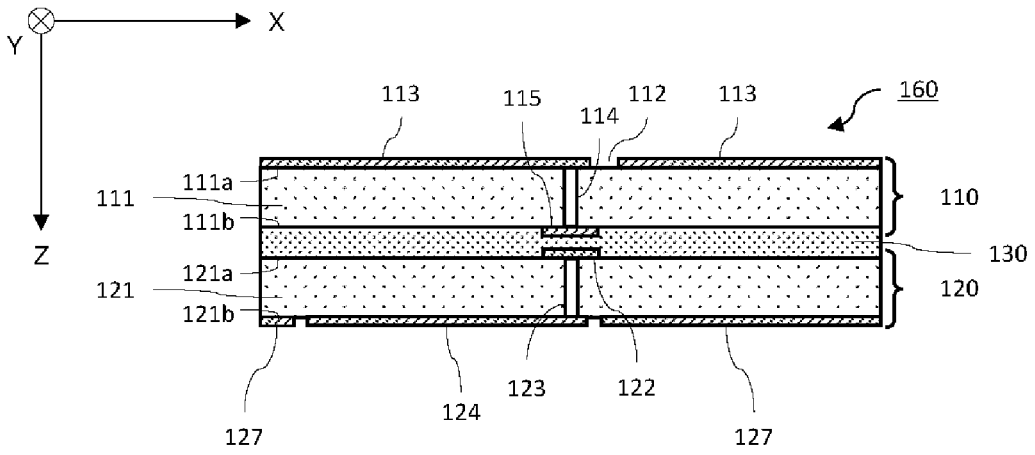
FIG. 6 is a sectional view of an antenna apparatus 160 according to a further variation of the first embodiment.

In the description of the antenna apparatus 100, the first signal line 124 is located in the second dielectric substrate 121, the first signal line 124 may be located on the fourth surface 121*b*. FIG. 6 illustrates an antenna apparatus 160 including the first signal line 124 located on the fourth surface 121*b*. FIG. 6 is a sectional view of the antenna apparatus 160, similar to the sectional view at the broken line L-L' of FIG. 1. The antenna apparatus 160 may not include the third conductor 125 and the pad 126. In the second substrate 120, the first signal line 124 is electrically connected to the second electrode 122 through the second conductor 123.

(Fourth Variation)

Figure 7:
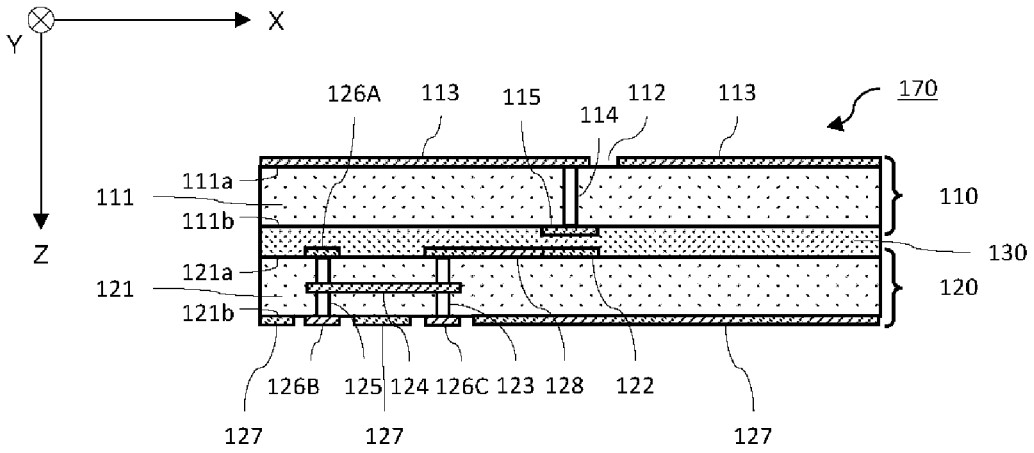
FIG. 7 is a sectional view of an antenna apparatus 170 according to a further variation of the first embodiment.

In the description of the antenna apparatus 100, the first conductor 114 and the second conductor 123 are represented to be continuous with the adhesive layer 130 in a penetrating direction (Z direction). The first conductor 114 and the second conductor 123 may be located at different positions in the penetrating direction (Z direction). FIG. 7 illustrates an antenna apparatus 170 including the first conductor 114 and the second conductor 123 located at the different positions. FIG. 7 is a sectional view of the antenna apparatus 170, similar to the sectional view at the broken line L-L' of FIG. 1. In a present variation, a second signal line 128 is located on the third surface 121*a*, and the second electrode 122 and the second conductor 123 are electrically connected. The second signal line 128 is an optional line of signal transmission. For example, the second signal line 128 may be a strip line, a microstrip line, a coplanar line, or the like. In the second substrate 120, the pad 126B is electrically connected to the second electrode 122 through the third conductor 125, the first signal line 124, the second conductor 123, and the second signal line 128.

The first conductor 114 and the second conductor 123 are located at different positions in the penetrating direction (Z direction), so that the first substrate 110 including the radiating element 112 and the second substrate 120 including the first signal line 124 can be independently designed. (Fifth Variation)

Figure 8:
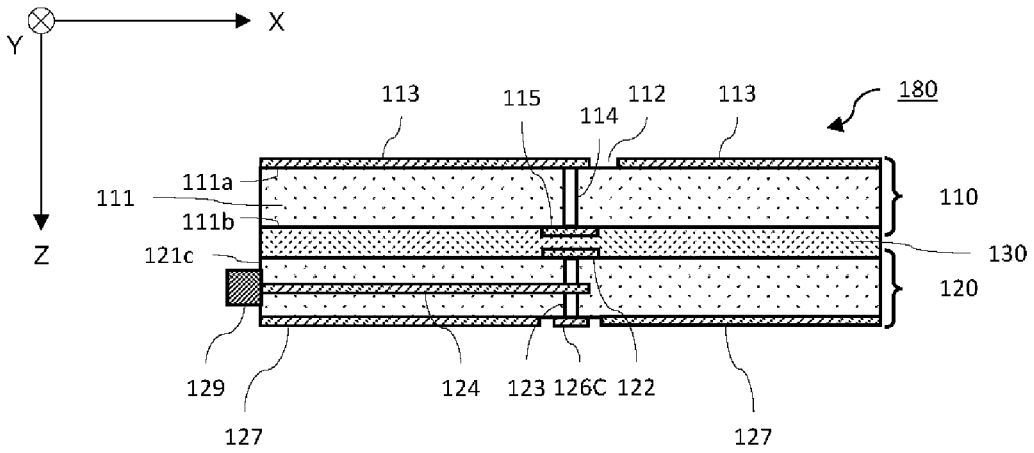
FIG. 8 is a sectional view of an antenna apparatus 180 according to a further variation of the first embodiment.

In the description of the antenna apparatus 100, the pad 126B is connected to the external electronic apparatus by the connector (not shown). The third conductor 125 or the first signal line 124 may be directly connected to the connector or the electronic apparatus without the pad 126B. FIG. 8 illustrates an antenna apparatus 180 as an example.

FIG. 8 illustrates the antenna apparatus 180 including the connector 129 connected to the first signal line 124. FIG. 8 is a sectional view of the antenna apparatus 180, similar to the sectional view at the broken line L-L' of FIG. 1. The connector 129 may be located on a surface of the second dielectric substrate 121 in the Y-Z plane view (hereinafter, also referred to as a fifth surface), and the second dielectric substrate 121 includes the first signal line 124. The connector 129 is connected to the first signal line 124 by solder (not shown) or the like. The antenna apparatus 180 may not include the third conductor 125 and the pads 126A and 126B. In the second substrate 120, the connector 129 is electrically connected to the second electrode 122 through the first signal line 124 and the second conductor 123.

The connector 129 may be an IC chip as the external electronic apparatus. The IC chip may be directly provided on an antenna apparatus, so that an entire apparatus including the external electronic apparatus and the antenna apparatus can be downsized. As described above, the antenna apparatus may be connected to the connector or the external electronic apparatus without the pad 126.

The variations of the present embodiment are described above. An antenna apparatus of the present embodiments is manufactured by adhering the manufactured first substrate 110 and the manufactured second substrate 120 by the adhesive layer 130, so that the first substrate 110 including the radiating element 112 and the second substrate 120 including the first signal line 124 can be independently designed, and the limitation on positions of the radiating element 112 and the first signal line 124 can be reduced. In a build-up method, the second conductor 123 and the third conductor 125 are formed in the second dielectric substrate 121, the first dielectric substrate 111 is laminated on the second dielectric substrate 121, and then the first conductor 114 is formed in the first dielectric substrate 111. In contrast to the build-up method, in the present embodiments, the first substrate 110 including the first conductor 114 and the second substrate 120 including the second conductor 123 and the third conductor 125 are respectively manufactured and adhered by the adhesive layer 130, so that manufacturing steps and cost can be reduced as compared with the build-up method.

Second Embodiment

Figure 9:
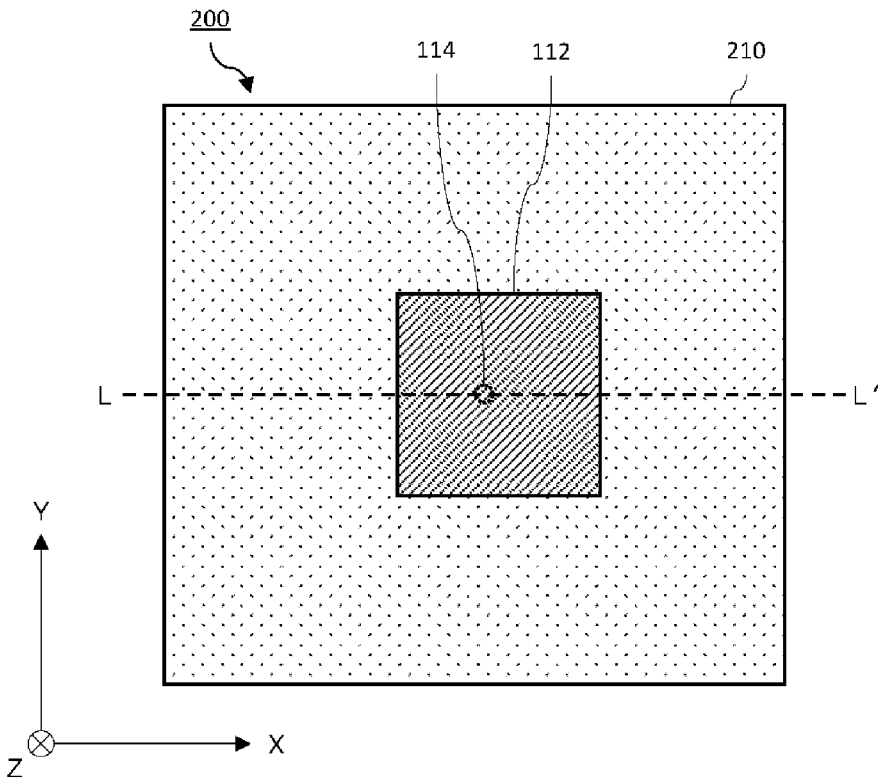
FIG. 9 is a top view of an antenna apparatus 200 according to a second embodiment.
Figure 10:
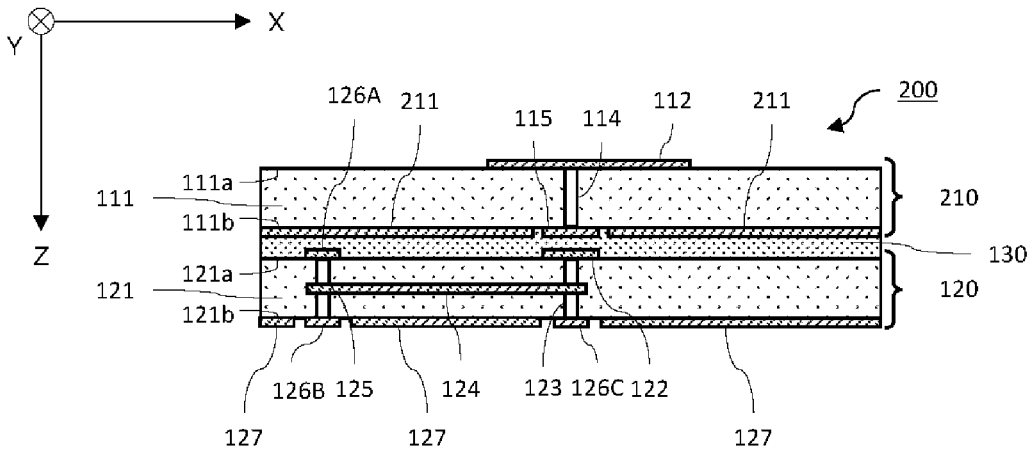
FIG. 10 is a sectional view of the antenna apparatus 200 according to the second embodiment.

Hereinafter, an antenna apparatus 200 according to the second embodiment is described. FIG. 9 is a top view of the antenna apparatus 200 (X-Y plane view). FIG. 10 is a sectional view at a broken line L-L' of the FIG. 9 (X-Z plane view).

The antenna apparatus 200 is manufactured by adhering a first substrate 210 and the second substrate 120 of the antenna apparatus 100 described in the first embodiment by the adhesive layer 130. The first substrate 210 further includes a first conductive plate 211 in addition to the first substrate 110 described in the first embodiment, and includes the radiating element 112 and a first conductive plate 211. As an example, the first substrate 210 does not include the first conductive layer 113 in FIG. 10, and the first substrate 210 may partly include the first conductive layer 113. The first substrate 210 includes the first conductive plate 211, so that in addition to effects of the first embodiment, leakage of a high-frequency signal in the antenna apparatus 200 can be prevented or reduced, and a reduction in gain and radiation efficiency of the antenna apparatus can be prevented or reduced.

The first substrate 210 is described with reference to FIG. 9 and FIG. 10. In a present embodiment, as an example, the radiating element 112' is described as the patch antenna, and other antennas such as a slot antenna may be used as described in the first embodiment. In FIG. 9, the first conductor 114 is described in the broken line.

The first conductive plate 211 is ground of the antenna apparatus 200, and a shield for preventing transmission of a high-frequency signal as noise for the radiating element 112 from the second substrate 120 to the first substrate 210. The first conductive plate 211 is also a shield for preventing transmission of a high-frequency signal as noise for the first signal line 124 from the first substrate 210 to the second substrate 120. The radiating element 112' and the first signal line 124 can reduce an electric influence of each other by the first conductive plate 211. The first conductive plate 211 may be a conductive material, formed on the second surface 111*b* by patterning. The conductive material is optional, in the present embodiment, and as an example the conductive material is copper. The conductive material may also be such as gold, silver, aluminum, tungsten, and alloys using these metals. The metal may be plated on a surface to prevent rust.

An electrical connection of the antenna apparatus 200 is the same as that of the antenna apparatus 140 described in the first variation of the first embodiment, and a description of the electrical connection of the antenna apparatus 200 is omitted.

The antenna apparatus 200 of the present embodiment is described above, and variations of the antenna apparatus 200 may be implemented and executed in various ways. For example, the first embodiment and the variations of the first embodiment may be similarly applied to the antenna apparatus 200.

The antenna apparatus 200 includes the first substrate 210 having the first conductive plate 211, so that in addition to the effects of the first embodiment, leakage of the high-frequency signal in the antenna apparatus 200 can be prevented or reduced, and reduction in gain and radiation efficiency of the antenna apparatus can be prevented or reduced.

Third Embodiment

Figure 11:
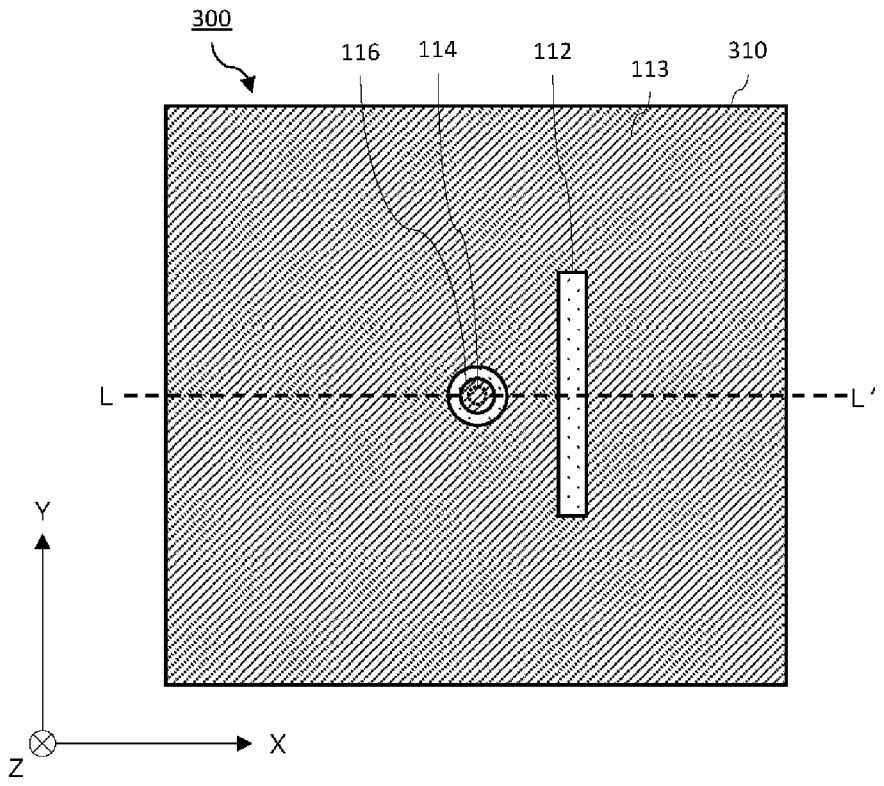
FIG. 11 is a top view of an antenna apparatus 300 according to a third embodiment.
Figure 12:
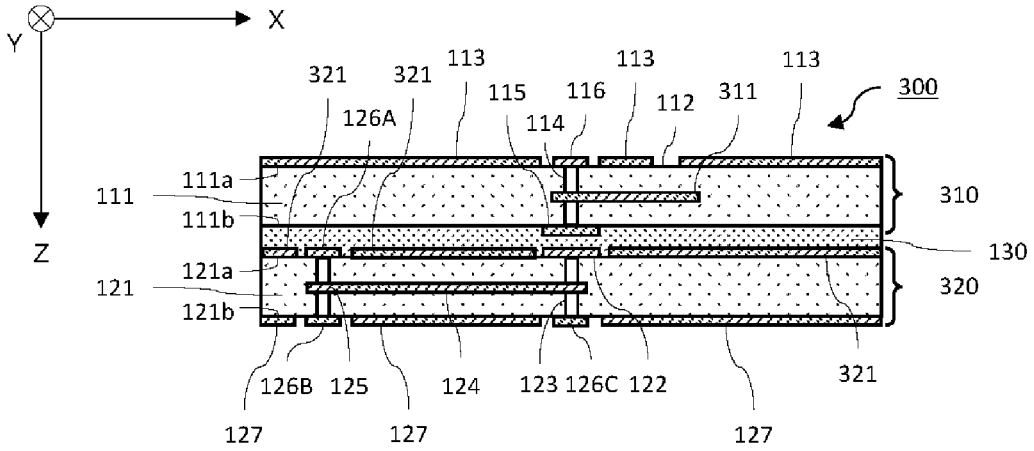
FIG. 12 is a sectional view of the antenna apparatus 300 according to the third embodiment.

Hereinafter, an antenna apparatus 300 according to a third embodiment is described. FIG. 11 is a top view of the antenna apparatus 300 (X-Y plane view). FIG. 12 is a sectional view at a broken line L-L' of the FIG. 11 (X-Z plane view).

The antenna apparatus 300 is manufactured by adhering a first substrate 310 including the radiating element 112 and a second substrate 320 including the first signal line 124 and a second conductive plate 321 by the adhesive layer 130. The second substrate 320 includes the second conductive plate 321, so that in addition to effects of the first embodiment, leakage of a high-frequency signal in the antenna apparatus 300 can be prevented or reduced, and reduction in the gain and radiation efficiency of the antenna apparatus can be prevented or reduced.

The first substrate 310 and the second substrate 320 are described with reference to FIG. 11 and FIG. 12. In a present embodiment, as an example, the radiating element 112 is described as the slot antenna, and other antennas such as the patch antenna may be used as described in the first embodiment and the second embodiment.

The first substrate 310 further includes a third signal line 311 in addition to the first substrate 110 described in the first embodiment. The third signal line 311 is located in the first dielectric substrate 111. The third signal line 311 is electrically connected to the first conductor 114 and is electrically connected to the radiating element 112 by electromagnetic coupling, that is, the third signal line 311 transmits and receives a high-frequency signal to and from the radiating element 112. In a present embodiment, the third signal line 311 is described as a strip line as an example. The pad 116 is located on the first surface 111*a*, connects the first conductor 114, and is separated from the first conductive layer 113.

The second substrate 320 further includes the second conductive plate 321 in addition to the first substrate 120 described in the first embodiment. The second conductive plate 321 is ground of the antenna apparatus 300, and a shield for preventing transmission of the high-frequency signal as noise for the radiating element 112 from the second substrate 320 to the first substrate 310. The second conductive plate 321 is also a shield for preventing transmission of the high-frequency signal as noise for the first signal line 124 from the first substrate 310 to the second substrate 320. The radiating element 112 and the first signal line 124 can reduce electric influence of each other by the second conductive plate 321. The second conductive plate 321 may be a conductive material, formed on the third surface 121*a* by patterning. The conductive material is optional, in the present embodiment, and as an example the conductive material is copper. The conductive material may also be such as gold, silver, aluminum, tungsten, and alloys using these metals. The metal may be plated on a surface to prevent rust.

An electrical connection in the antenna apparatus 300 is described. In the first substrate 310, the radiating element 112 and the third signal line 311 are electrically connected by electromagnetic coupling, and the third signal line 311 connects electrically to the first electrode 115 through the first conductor 114. In the second substrate 320, the pad 126B is electrically connected to the second electrode 122 through the third conductor 125, the first signal line 124, and the second conductor 123. The first electrode 115 and the second electrode 122 are electrically connected by electromagnetic coupling.

The antenna apparatus 300 of the present embodiment is described above, and variations of the antenna apparatus 300 may be implemented and executed in various ways. For example, the first embodiment, the second embodiment, and the variations of the first embodiment may be similarly applied to the antenna apparatus 300.

The antenna apparatus 300 includes the second substrate 320 having the second conductive plate 321, so that in addition to the effects of the first embodiment, leakage of a high-frequency signal in the antenna apparatus 300 can be prevented or reduced, and reduction in gain and radiation efficiency of the antenna apparatus can be prevented or reduced.

Fourth Embodiment

Figure 13:
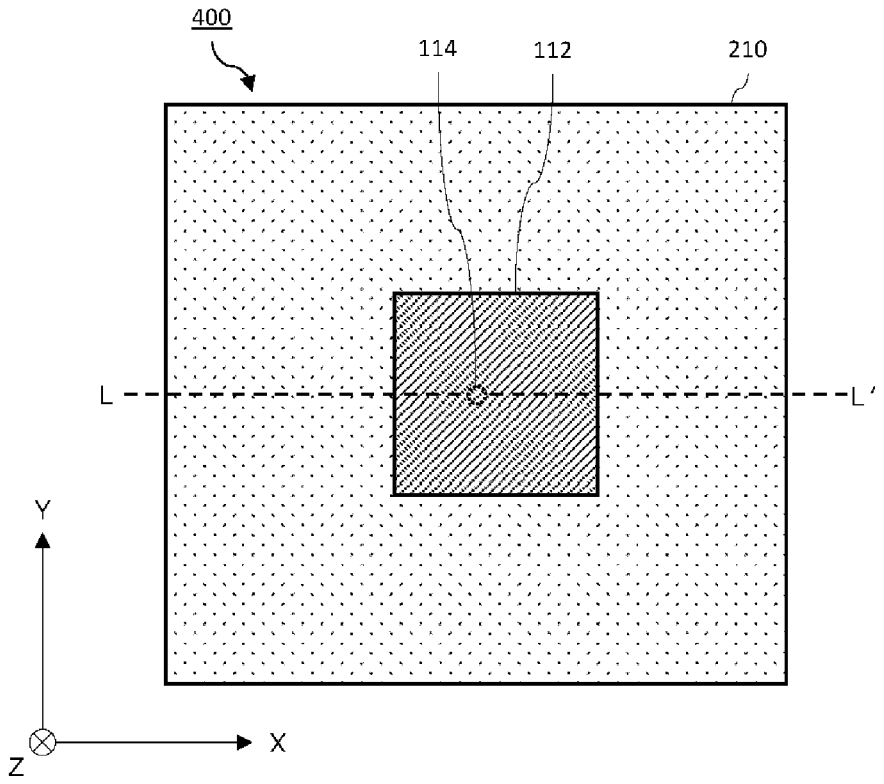
FIG. 13 is a top view of an antenna apparatus 400 according to a fourth embodiment.
Figure 14:
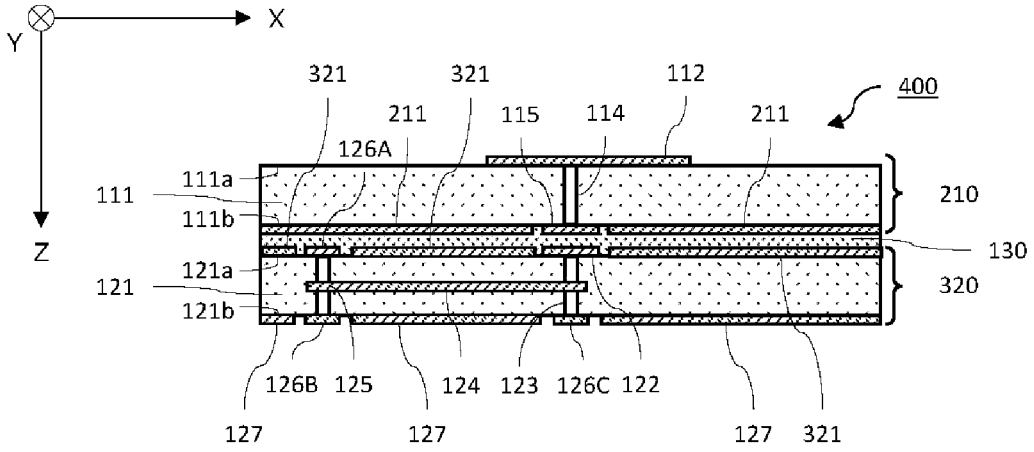
FIG. 14 is a sectional view of the antenna apparatus 400 according to the fourth embodiment.

Hereinafter, an antenna apparatus 400 according to the fourth embodiment is described. FIG. 13 is a top view of the antenna apparatus 400 (X-Y plane view). FIG. 14 is a sectional view at a broken line L-L' of the FIG. 13 (X-Z plane view).

The antenna apparatus 400 is manufactured by adhering the first substrate 210 described in the second embodiment and the second substrate 320 described in the third embodiment by the adhesive layer 130. The first substrate 210 includes the first conductive plate 211 and the second substrate 320 includes the second conductive plate 321, so that leakage of a high-frequency signal in the antenna apparatus 400 can be further prevented or reduced, reduction in gain and radiation efficiency of the antenna apparatus further can be prevented or reduced than in the second and the third embodiment. When both the first conductive plate 211 and the second conductive plate 321 are provided, transmission of a high-frequency signal in a parallel plate mode can be prevented or reduced by reducing the thickness (Z direction) of the adhesive layer 130.

In a present embodiment, as an example, the radiating element 112' is described as the patch antenna, and other antennas such as the slot antenna may be used as described in the first embodiment to the third embodiment.

An electrical connection of the antenna apparatus 400 is the same as that of the antenna apparatus 140 described in the first variation of the first embodiment, and a description of the electrical connection of the antenna apparatus 400 is omitted.

The antenna apparatus 400 of the present embodiment is described above, and variations of the antenna apparatus 400 may be implemented and executed in various ways. For example, the first embodiment to the third embodiment, and the variations of the first embodiment may be similarly applied to the antenna apparatus 400.

The antenna apparatus 400 includes the first substrate 210 having the first conductive plate 211 and the second substrate 320 having the second conductive plate 321, so that in addition to the effects of the first embodiment, leakage of a high-frequency signal in the antenna apparatus 400 can be further prevented or reduced, and reduction in gain and radiation efficiency of the antenna apparatus further can be prevented or reduced than in the second and the third embodiment.

Fifth Embodiment

Figure 15:
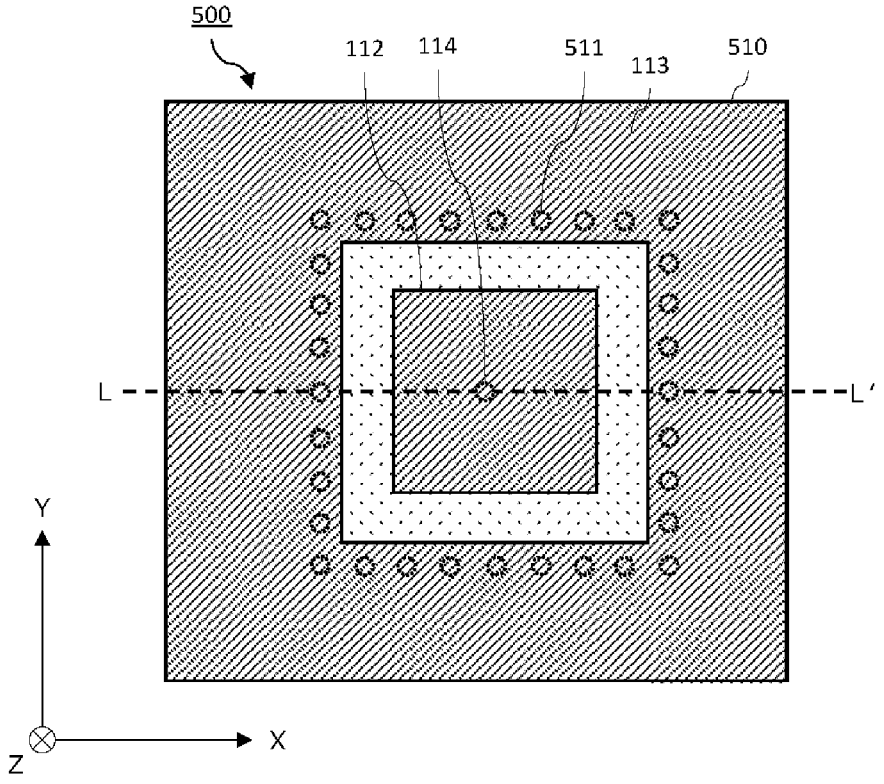
FIG. 15 is a top view of an antenna apparatus 500 according to a fifth embodiment.
Figure 16:
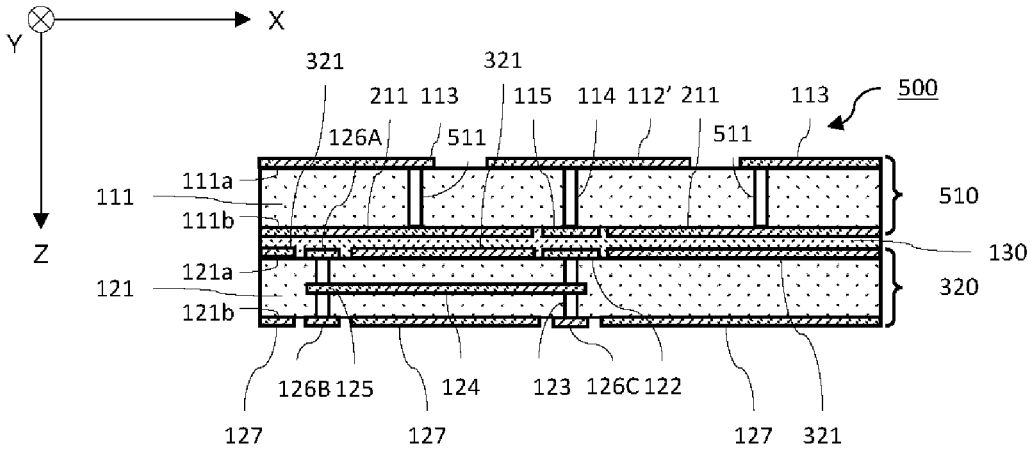
FIG. 16 is a sectional view of the antenna apparatus 500 according to the fifth embodiment.

Hereinafter, an antenna apparatus 500 according to the fifth embodiment is described. FIG. 15 is a top view of the antenna apparatus 500 (X-Y plane view). FIG. 16 is a sectional view at a broken line L-L' of the FIG. 15 (X-Z plane view).

The antenna apparatus 500 is manufactured by adhering a first substrate 510 and the second substrate 320 described in the third embodiment by the adhesive layer 130. The first substrate 510 further includes one or more fourth conductors 511 and the first conductor layer 113 in addition to the first substrate 210 described in the second embodiment; that is, the first substrate 510 includes the radiating element 112, the first conductor plate 211, and the fourth conductors 511. The first substrate 510 includes the fourth conductors 511, so that in addition to effects of the fourth embodiment, propagation of an unnecessary high-frequency signal in a direction parallel to the first substrate 510 (X-Y plane) can be prevented or reduced, and reduction in gain and radiation efficiency of the antenna apparatus can be prevented or reduced.

The first substrate 510 is described with reference to FIG. 15 and FIG. 16. In a present embodiment, as an example, the radiating element 112' is described as the patch antenna, and other antennas such as the slot antenna may be used as described in the first embodiment to the fourth embodiment.

The first substrate 510 includes the fourth conductors 511. The fourth conductors 511 prevent or reduce propagation of the unnecessary high-frequency signal in the direction parallel to the first substrate 510 (X-Y plane) inside the antenna apparatus 500.

The fourth conductors 511 connect electrically the first conductive layer 113 and the first conductive plate 211. The fourth conductors 511 are provided through the first dielectric substrate 111 from the first surface 111*a* to the second surface 111*b* (Z direction). In FIG. 15, the fourth conductors 511 are described in broken line. The fourth conductors 511 may be the through holes plated with the conductive material. The fourth conductors 511 may be through holes filled with a conductivity filler. As shown in FIG. 15 and FIG. 16, in a present embodiment, the fourth conductors 511 are plural, and are located to surround the radiating element 112 in a direction perpendicular to the antenna apparatus 500 (Z direction).

Most electrical connections of the antenna apparatus 500 are the same as that of the antenna apparatus 400 described in the fourth embodiment, and thus only differences are described. In the first substrate 510, the fourth conductors 511 are electrically connected to the first conductive layer 113 and the first conductive plate 211.

The antenna apparatus 500 of the present embodiment is described above, and variations of the antenna apparatus 500 may be implemented and executed in various ways. For example, the first embodiment to the fourth embodiment, and the variations of the first embodiment may be similarly applied to the antenna apparatus 500. Hereinafter, the variations of the antenna apparatus 500 are described.

Figure 17:
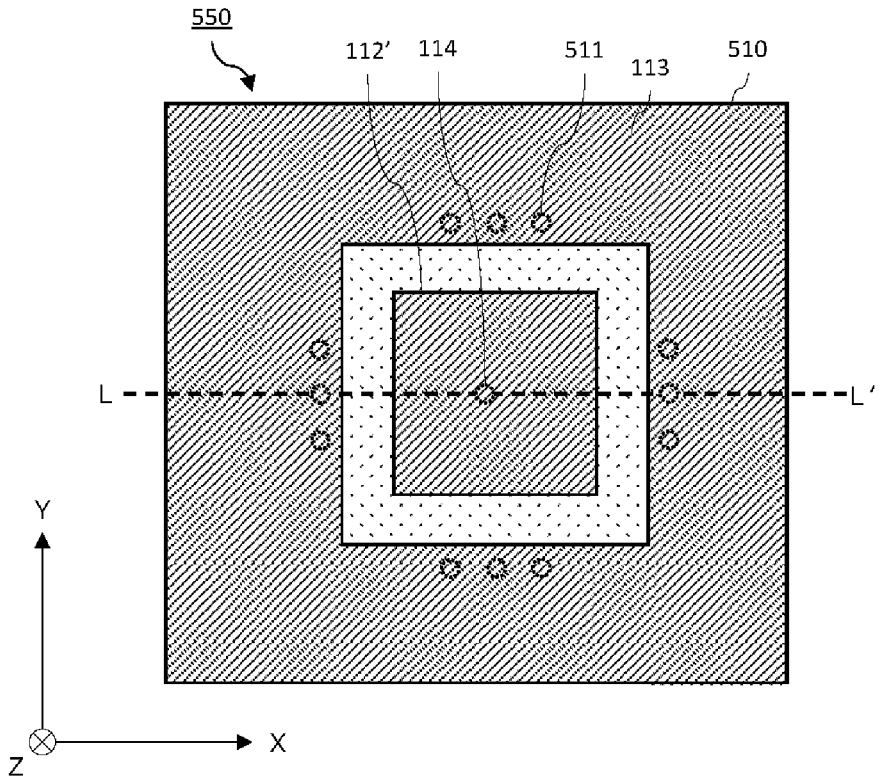
FIG. 17 is a sectional view of an antenna apparatus 550 according to a variation of the fifth embodiment.

The fourth conductors 511 included in the antenna apparatus 500 are located to surround the radiating element 112 in the Z direction, but are not limited to the arrangement in FIG. 15. For example, FIG. 17 illustrates a top view (X-Y plane) of an antenna apparatus 550 as a variation of the antenna apparatus 500. The fourth conductors 511 of the antenna apparatus 550 are located along a side of the radiating element 112 and are not located near a corner of the radiating element 112. Even in the event of the antenna apparatus 550, the fourth conductors 511 are included surrounding the radiating element 112 in the Z direction.

Figure 18:
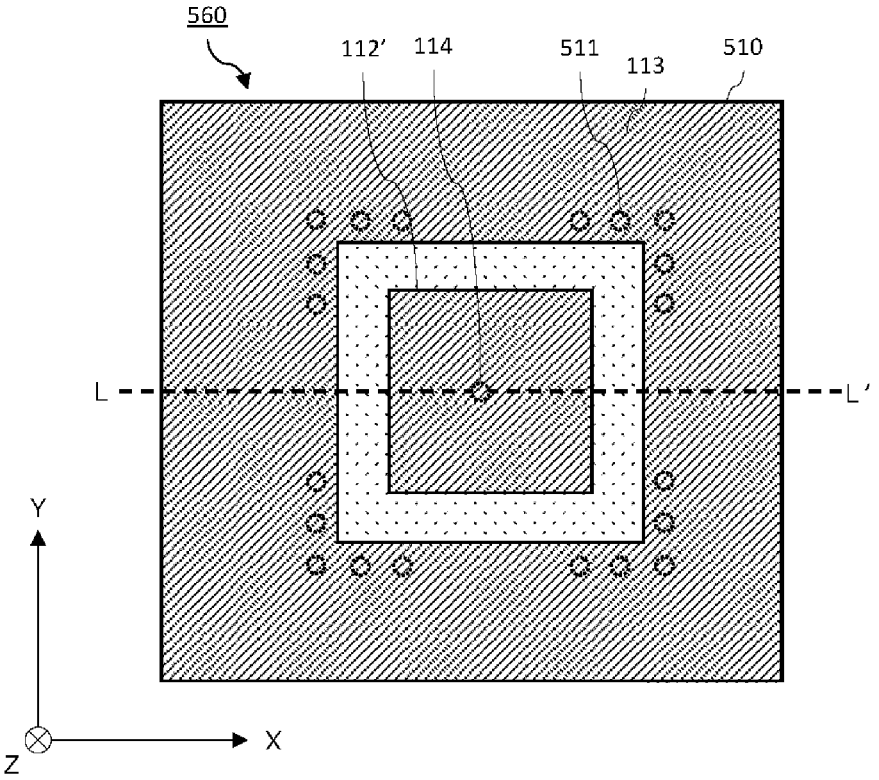
FIG. 18 is a sectional view of an antenna apparatus 560 according to a further variation of the fifth embodiment.

FIG. 18 illustrates a top view (X-Y plane view) of an antenna apparatus 560 as another variation of the antenna apparatus 500. The fourth conductors 511 of the antenna apparatus 560 are located near the corners of the radiating element 112 and are not located along the sides of the radiating element 112. Even in the event of the antenna apparatus 560, the fourth conductors 511 are included surrounding the radiating element 112 in the Z direction.

In the antenna apparatus 500 and these variations, in the event that the interval between a plurality of the fourth conductors 511 is smaller than the wavelength of a frequency of a signal radiated or transmitted by the antenna apparatus, for example such as less than half the wavelength, the propagation of the high-frequency signal in the direction parallel to the first substrate 510 (X-Y plane) can be prevented or reduced, and reduction in gain and radiation efficiency of the antenna apparatus can be prevented or reduced by the fourth conductors 511.

The antenna apparatus 500 includes the first substrate 510 having the fourth conductors 511, so that in addition to the effects of the fourth embodiment, the propagation of an unnecessary high-frequency signal in the direction parallel to the first substrate 510 (X-Y plane) can be prevented or reduced, and reduction in gain and radiation efficiency of the antenna apparatus can be prevented or reduced.

Sixth Embodiment

Figure 19:
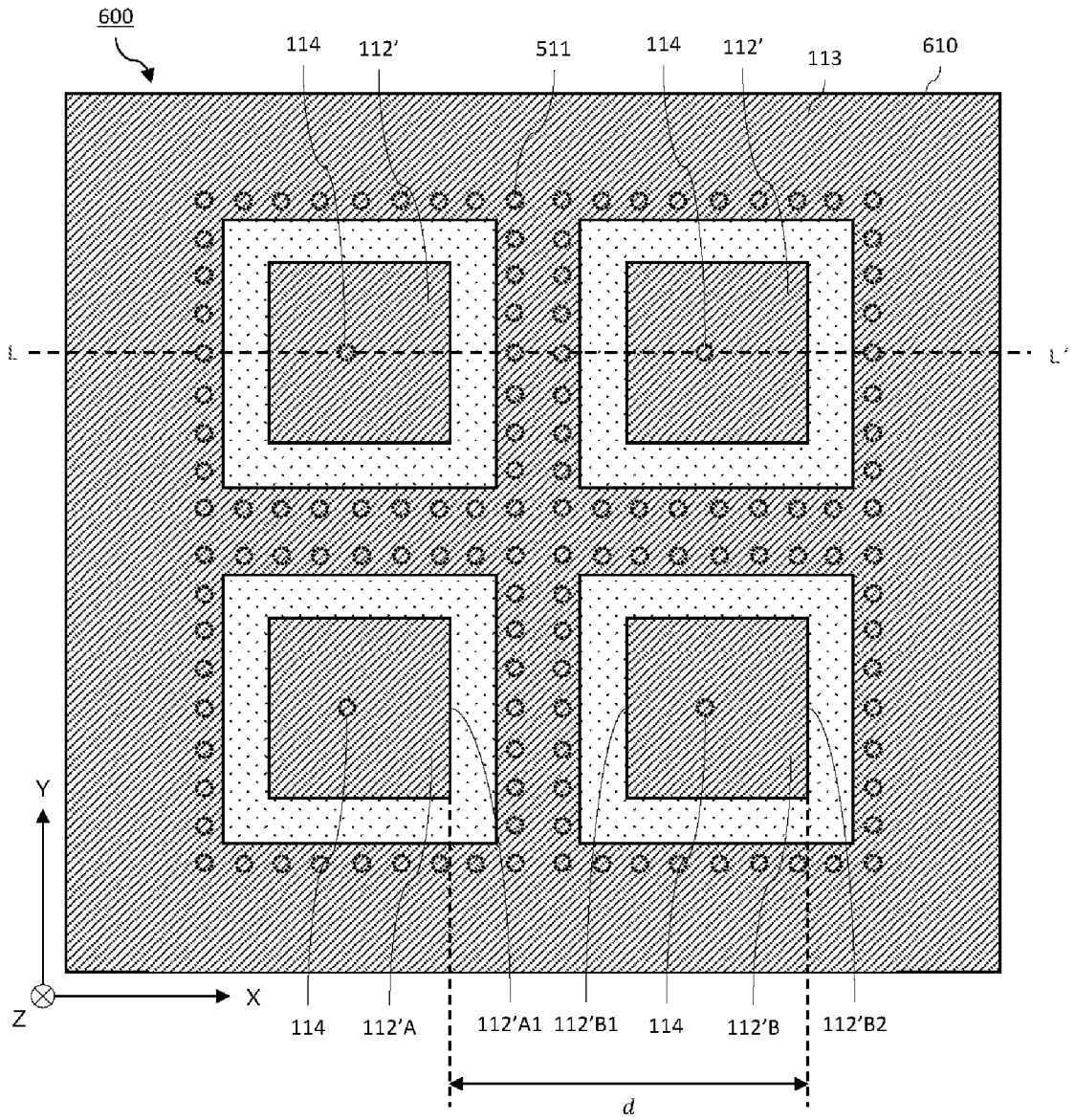
FIG. 19 is a top view of an antenna apparatus 600 according to a sixth embodiment.
Figure 20:
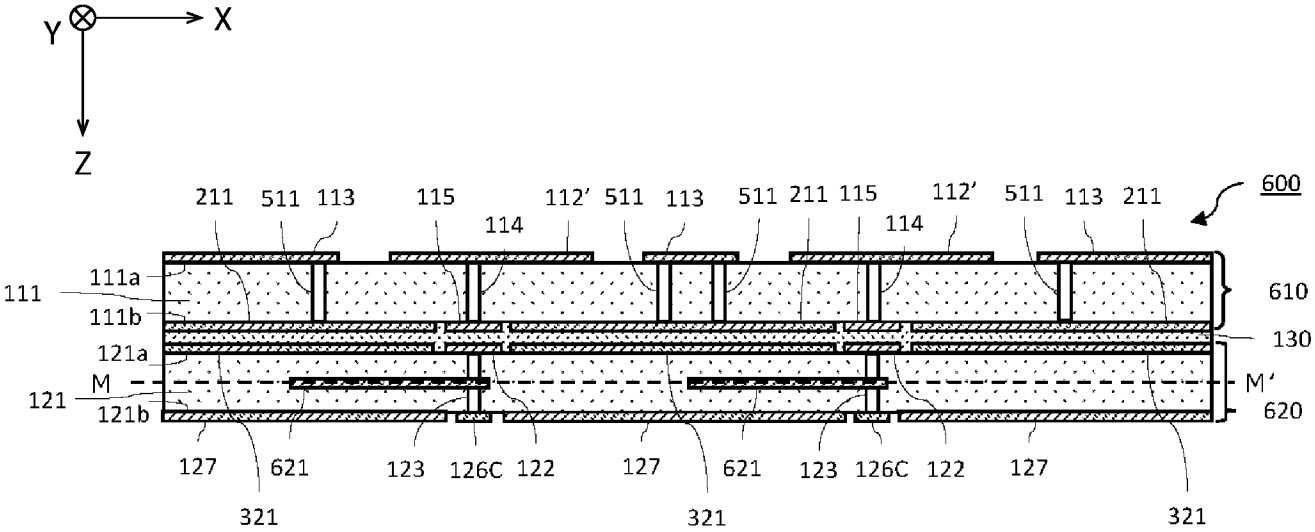
FIG. 20 is a sectional view of the antenna apparatus 600 according to the sixth embodiment.
Figure 21:
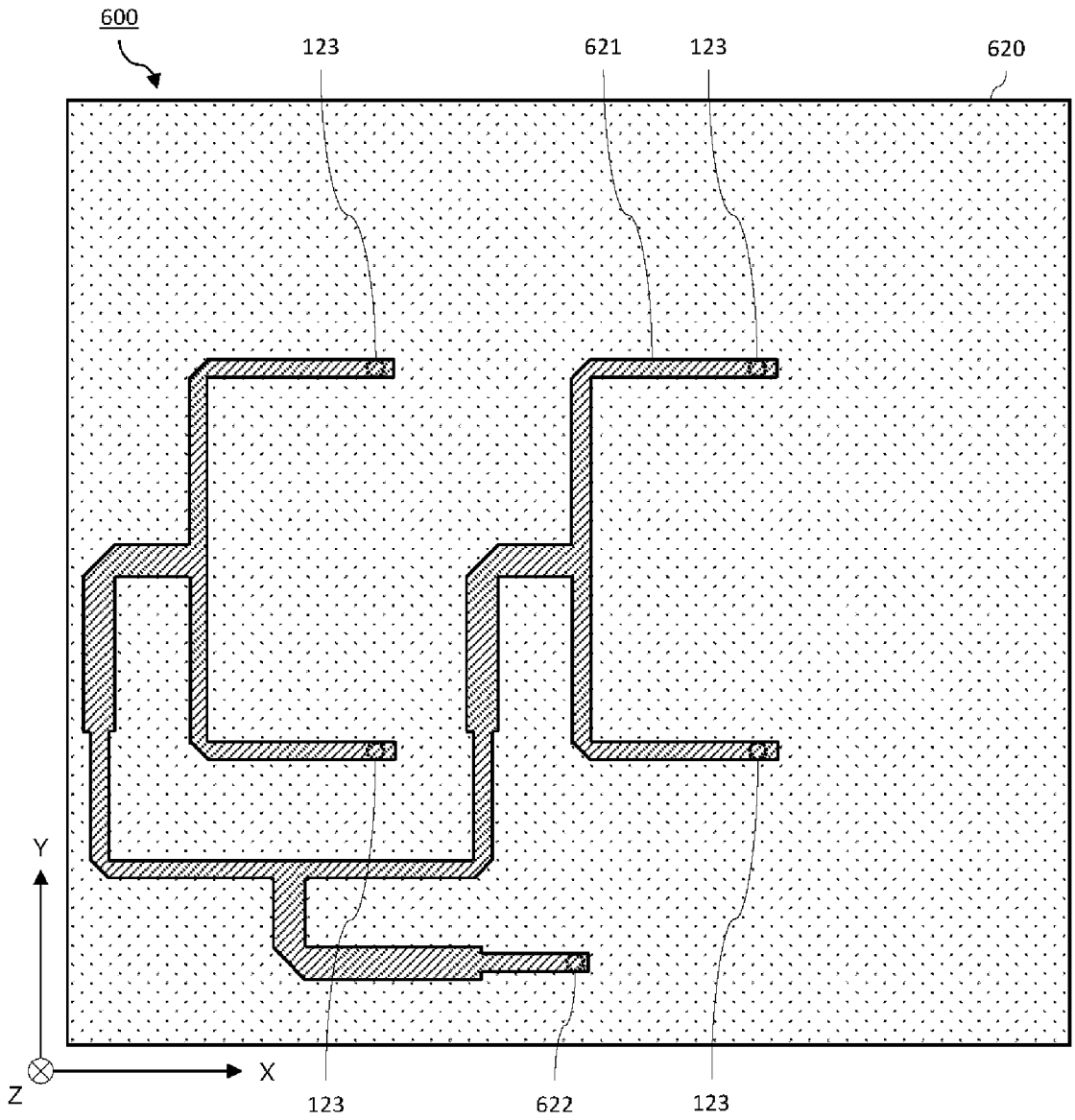
FIG. 21 is a diagram illustrating a fourth signal line 621 according to the sixth embodiment.

Hereinafter, an antenna apparatus 600 according to the sixth embodiment is described. FIG. 19 is a top view of the antenna apparatus 600 (X-Y plane view). FIG. 20 is a sectional view at a broken line L-L' of the FIG. 19 (X-Z plane view). FIG. 21 is a sectional view at a broken line M-M' of the FIG. 20 (X-Y plane view).

The antenna apparatus 600 is an array antenna apparatus in which the antenna apparatuses 500 described in the fifth embodiment are arrayed. The antenna apparatus 600 is manufactured by adhering a first substrate 610 and the second substrate 620 by the adhesive layer 130. The first substrate 610 includes a plurality of at least some of the components of the first substrate 510. For example, a plurality of the radiating elements 112', the first conductors 114, and the first electrodes 115 are provided. The second substrate 620 includes a plurality of at least some of the components of the second substrate 620. For example, a plurality of the second electrodes 122, the second conductors 123, and the pads 126C are provided. By arraying the antenna apparatuses, the gain of the antenna apparatus can be improved in addition to effects of the fifth embodiment.

Further, by arranging the radiating elements 112', the antenna apparatus 600 can be downsized. This arrangement is described with reference to radiating elements 112'A and 112'B shown in FIG. 19. The radiating elements 112'A and 112'B are located with sides 112'A1 and 112'B facing each other. A distance d from the side 112'A1 to a side 112'B2 opposite to the side 112'B1 is one third or less of the wavelength of the electromagnetic waves radiated and received by the radiating elements 112'A and 112'B. As described above, the antenna apparatus can be downsized.

The second substrate 620 includes a fourth signal line 621. As shown in FIG. 21, the fourth signal line 621 is electrically connected to the external electronic apparatus through a fifth conductor 622, and is electrically connected to the plurality of second conductors 123. The high-frequency signal is transmitted between the external electronic apparatus and the plurality of radiating elements 112' by the fourth signal line 621, and the array antenna apparatus can be realized.

The first substrate 610 and the second substrate 620 are described with reference to FIG. 20 and FIG. 21. In a present embodiment, as an example, the radiating elements 112' are described as the patch antennas, and other antennas such as the slot antennas may be used as described in the first embodiment to the fifth embodiment.

The first substrate 610 has components similar to the first substrate 510 described in the fifth embodiment, and a description of the first substrate 610 is omitted. The second substrate 620 further includes the fourth signal line 621 and the fifth conductor 622 in addition to components of the second substrate 520 described in the fifth embodiment. The fourth signal line 621 electrically connects the external electronic apparatus to the plurality of second conductors 123 and transmits the high-frequency signal. The fourth signal line 621 is electrically connected to the external electronic apparatus through the fifth conductor 622 described later. The fourth signal line 621 is an optional line of signal transmission. For example, the fourth signal line 621 may be a strip line, a microstrip line, a coplanar line, or the like. In the present embodiment, the fourth signal line 621 is the microstrip as an example.

The fifth conductor 622 electrically connects the fourth signal line 621 to the external electronic apparatus. The fifth conductor 622 is provided in the second dielectric substrate 121 in the Z direction. In FIG. 21, a connection between the fifth conductor 622 and the fourth signal line 621 is illustrated by a broken line. In FIG. 21, a connection between the second conductor 123 and the fourth signal line 621 is also illustrated by a broken line. The fourth conductor 511 is a through hole plated with a conductive material. The fifth conductor 622 may be a through hole filled with a conductivity filler.

An electrical connection of the antenna apparatus 600 is described. The antenna apparatus 600 may be electrically connected to the second electrodes 122 from the external electronic apparatus (not shown) through the fifth conductor 622, the fourth signal line 621, and the second conductors 123. The second electrodes 122 are electrically connected to the first electrodes 115 by electromagnetic coupling. The first electrodes 115 are electrically connected to the radiating elements 112 through the first conductors 114.

The antenna apparatus 600 of the sixth embodiment is described above, and variations of the antenna apparatus 600 may be implemented and executed in various ways. For example, the first embodiment to the fifth embodiment, and the variations of the first embodiment and the fifth embodiment may be similarly applied to the antenna apparatus 600. Hereinafter, variations of the antenna apparatus 600 are described.

(Variation)

In the antenna apparatus 600, signals are transmitted from the external electronic apparatus to the plurality of the radiating elements 112 through the fourth signal line 621. In a first variation, the connectors 129 may be provided on the fourth surface 121*b* to transmit the signal from the external electronic apparatus to each of the radiating elements 112. The connectors 129 may each be an IC chip as the external electronic apparatus.

Figure 22:
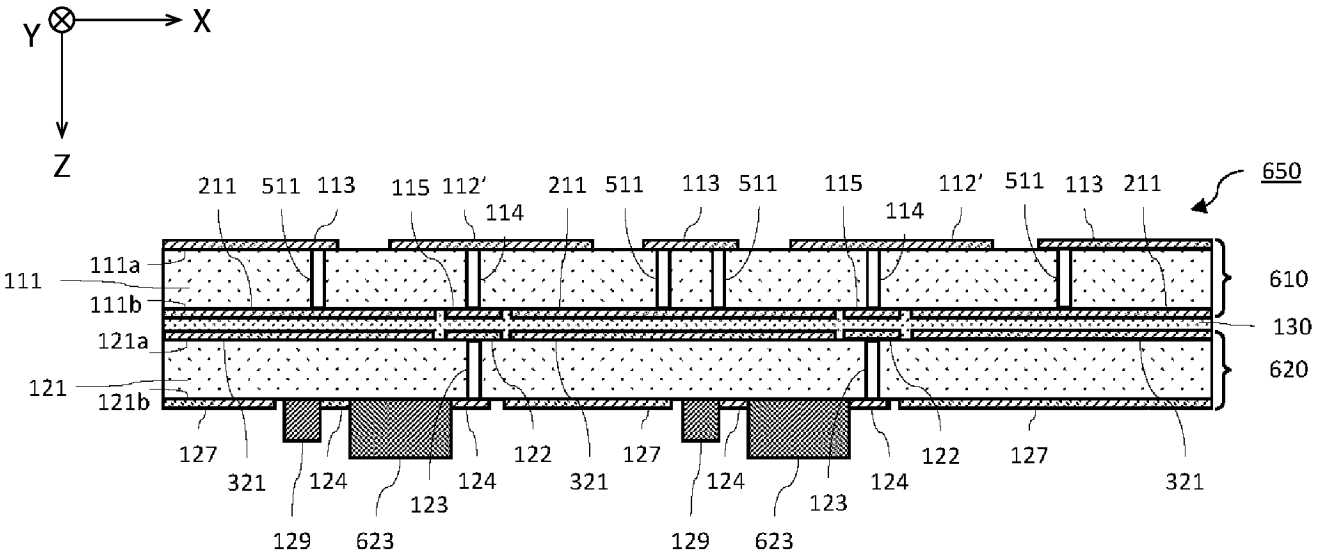
FIG. 22 is a sectional view of an antenna apparatus 650 according to a variation of the sixth embodiment.

FIG. 22 illustrates an antenna apparatus 650 as described above. FIG. 22 is a sectional view of the antenna apparatus 650, similar to the sectional view at the broken line L-L' of FIG. 19. The second substrate 620 of the antenna apparatus 650 may further include one or more electronic components 623 for signal transmission on the fourth surface 121*b*. The electronic components 623 are one or more components that improve the transmission and reception efficiency of the antenna apparatus 650. For example, each electronic component 623 may be a phase shifter, an inductor, a capacitor, a resistor, a band limiting filter, an amplifier, or the like. The connectors 129, the electronic components 623, and the second conductors 123 are electrically connected by the first signal lines 124 located on the fourth surface 121*b* (or in the second dielectric substrate 121).

An electrical connection of the antenna apparatus 650 is described. The external electronic apparatus (not shown) is electrically connected to the second electrodes 122 through the connectors 129, the first signal lines 124, the electronic components 623, and the second conductors 123. The second electrodes 122 are electrically connected to the first electrodes 115 by electromagnetic coupling. The first electrodes 115 are electrically connected to the radiating elements 112 through the first conductors 114.

The antenna apparatus 650 can transmit signals from the external electronic apparatus to each of the radiating elements 112 by providing the connectors 129 on the fourth surface 121*b*. Further, the electronic components 623 may be provided on the fourth surface 121*b*, so that in addition to the effects of the fifth embodiment, the antenna apparatus 650 including the connectors 129 and the electronic components 623 can be downsized. The connectors 129, the electronic components 623, and the second conductors 123 are electrically connected by the first signal lines 124 located on the fourth surface 121*b* (or in the second dielectric substrate 121).

The variations of the present embodiment are described above. The antenna apparatus of the present embodiment is an array antenna apparatus of the antenna apparatuses 500 described in the fifth embodiment, so that in addition to the effects of the fifth embodiment, the gain of the antenna apparatus can be improved.

Seventh Embodiment

Figure 23:
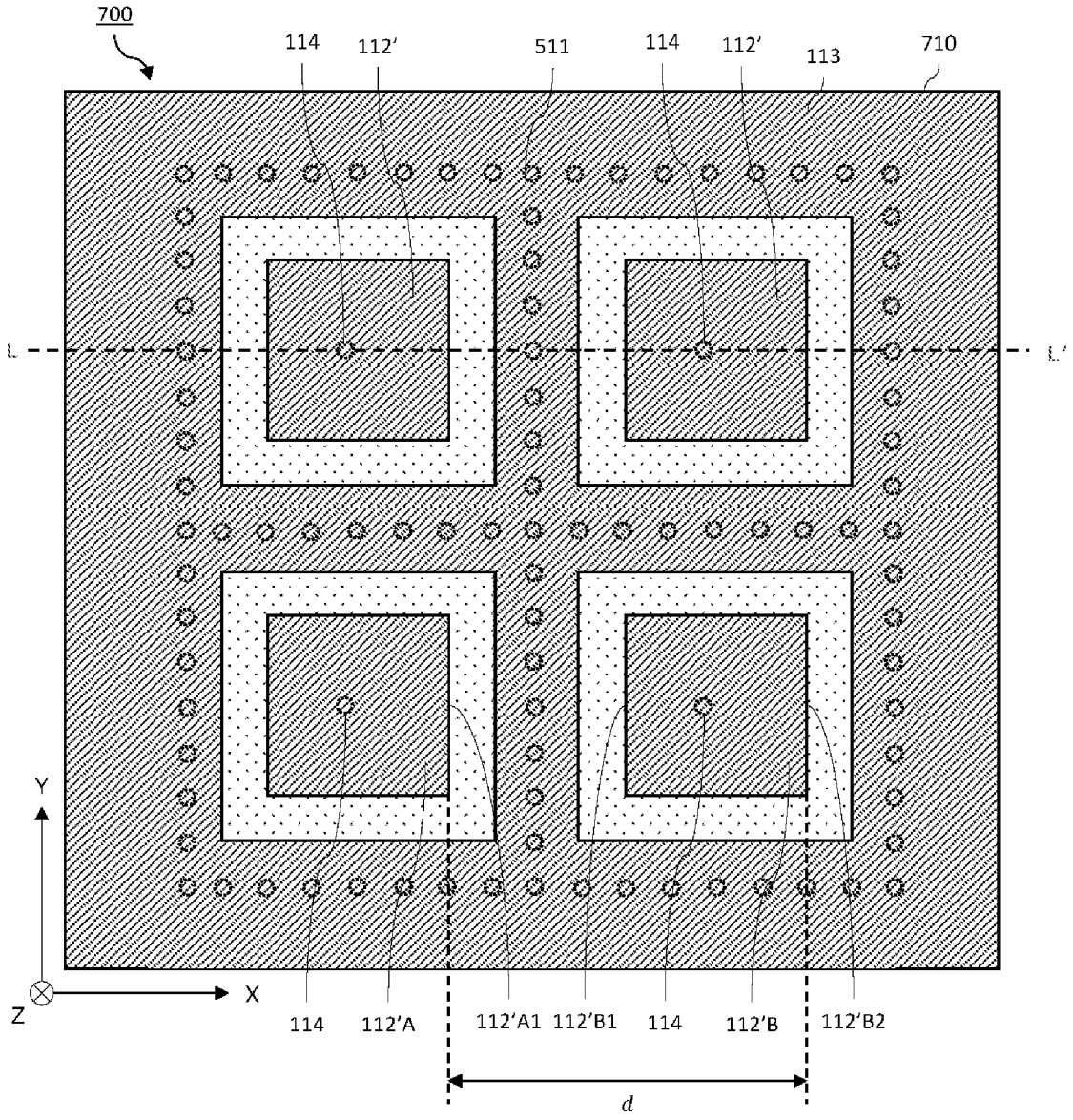
FIG. 23 is a top view of an antenna apparatus 700 according to a seventh embodiment.

Hereinafter, an antenna apparatus 700 according to the seventh embodiment is described. FIG. 23 is a top view of the antenna apparatus 700 (X-Y plane view). In the antenna apparatus 600 of the sixth embodiment, the propagation of the high-frequency signal in the direction parallel to the first substrate 610 (X-Y plane) is prevented or reduced by the fourth conductors 511 surrounding each of the radiating elements 112'. In the antenna apparatus 700, at least one of the fourth conductors 511 surrounding one of the radiating elements 112' (112'A) matches at least one of the fourth conductors 511 surrounding another one of the radiating elements 112' (112'B). Thereby, the antenna apparatus can be downsized. An electrical connection of the antenna apparatus 700 is the same as that of the antenna apparatus 600 of the sixth embodiment, and a description of the electrical connection is omitted.

As described in the sixth embodiment, the distance d between the plurality of the radiating elements 112 is equal to or less than one third of the wavelength of the electromagnetic wave radiated and received by the radiating elements 112. Thereby the antenna apparatus can be further downsized.

The antenna apparatus 700 of the seventh embodiment is described above, variations of the antenna apparatus 700 may be implemented and executed in various ways. For example, the first embodiment to the sixth embodiment, and the variations of the first embodiment to the sixth embodiment may be similarly applied to the antenna apparatus 700. Hereinafter, the variation of the antenna apparatus 700 is described.

(Variation)

Figure 24:
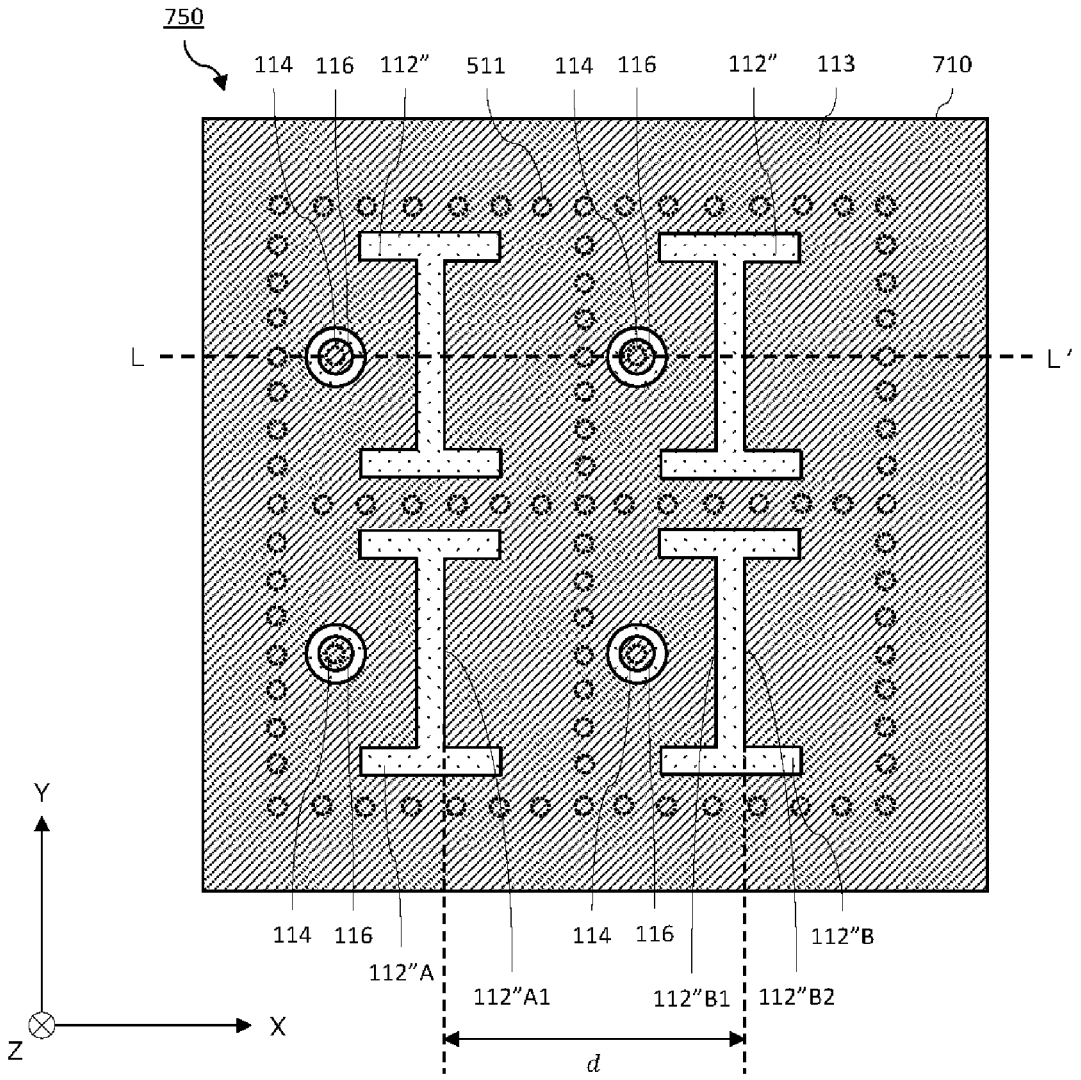
FIG. 24 is a top view of an antenna apparatus 750 according to a variation of the seventh embodiment.
Figure 25:
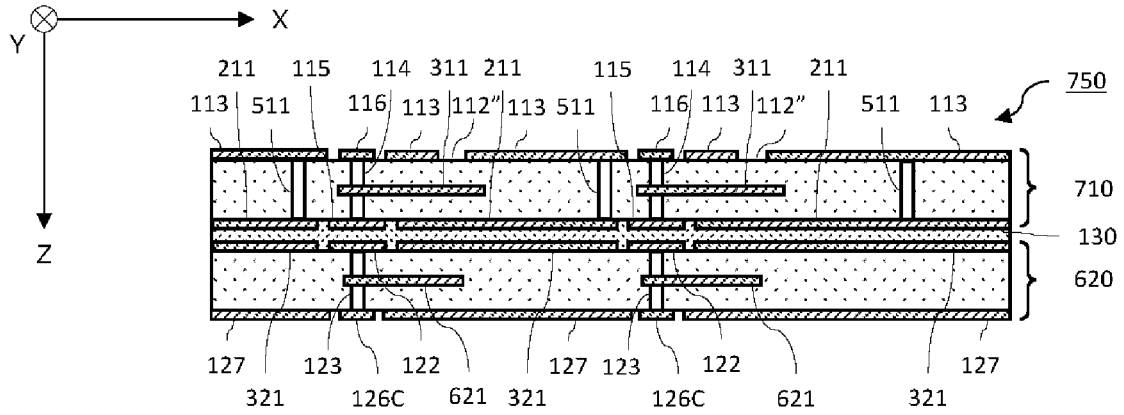
FIG. 25 is a sectional view of the antenna apparatus 750 according to a further variation of the seventh embodiment.

In the antenna apparatus 700, the radiating elements 112 may be the slot antenna. An antenna apparatus 750 having the slot antennas is described. FIG. 24 is a top view of the antenna apparatus 750 (X-Y plane view). FIG. 25 is a sectional view at a broken line L-L' of the FIG. 24 (X-Z plane view).

The antenna apparatus 750 is an antenna apparatus in which the radiating elements 112" of the antenna apparatus 700 described in this embodiment are the slot antennas. The radiating elements 112" of a present variation are H-shaped slot antennas. Thereby the antenna apparatus can be further downsized.

As described in the sixth embodiment, the distance d between the plurality of the radiating elements 112" is equal to or less than one third of the wavelength of the electromagnetic wave radiated and received by the radiating elements 112". Thereby the antenna apparatus can be further downsized.

An electrical connection of the antenna apparatus 750 is described. The external electronic apparatus (not shown) is electrically connected to the second electrodes 122 through the fifth conductor 622, the fourth signal lines 621, and the second conductors 123. The second electrodes 122 are electrically connected to the first electrodes 115 by electromagnetic coupling. The first electrodes 115 are electrically connected to the third signal lines 311 through the first conductors 114. The third signal lines 311 are electrically connected to the radiating elements 112".

The variation of the antenna apparatus 700 according to the seventh embodiment is described above. The antenna apparatus of the present embodiment includes the plurality of the fourth conductors 511 surrounding each of the plurality of the radiating elements 112" such as the antenna apparatus 600 described in the sixth embodiment. In the antenna apparatus of the present embodiment, at least one of the fourth conductors 511 among the fourth conductors 511 surrounding each of the plurality of the radiating elements 112 matches. Thereby, the antenna apparatus can be downsized. The radiating elements 112" are H-shaped slot antennas, so that the antenna apparatus can be further downsized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna apparatus, comprising:

a first dielectric substrate including a first surface and a second surface opposite to the first surface;

a radiating element located on the first surface or in the first dielectric substrate;

a first electrode on the second surface;

a first conductor provided through the first dielectric substrate from the first surface to the second surface, to connect electrically the radiating element and the first electrode;

a second dielectric substrate including a third surface and a fourth surface opposite to the third surface;

an adhesive layer between the second surface and the third surface;

a second electrode on the third surface;

a first signal line located on the fourth surface or in the second dielectric substrate; and a second conductor provided through the second dielectric substrate from the third surface to the fourth surface, to connect electrically the second electrode and the first signal line.

2. The antenna apparatus according to claim 1, wherein the first electrode and the second electrode form a capacitor, the capacitor having capacitance corresponding to a frequency of a signal radiated by the radiating element.

3. The antenna apparatus according to claim 1, further comprising:

at least one of: a first conductive plane on the second surface; a second conductive plane on the third surface.

4. The antenna apparatus according to claim 1, further comprising:

a second signal line located on the second surface or in the first dielectric substrate, wherein the second signal line is electrically connected with the first conductor and is electromagnetic coupling with the radiating element.

5. The antenna apparatus according to claim 1, wherein at least one of the first conductor or the second conductor comprises a through hole plated with a metal or a through hole filled with a conductivity filler.

6. The antenna apparatus according to claim 1, further comprising:

a conductive layer on the first surface; and a plurality of third conductors provided from the first surface to the second surface being electrically connected with the conductive layer, wherein the third conductors surround the radiating element viewed from a through direction of the first dielectric substrate.

7. The antenna apparatus according to claim 6, wherein at least one of the third conductors comprises a through hole plated with a metal or a through hole filled with a conductivity filler.

8. An array antenna apparatus comprising:

a plurality of the antenna apparatus, each being the antenna apparatus according to claim 1.

9. The antenna apparatus according to claim 6, wherein the radiating element includes a first radiating element and a second radiating element, and at least one of the third conductors surrounds the first radiating element and the second radiating element.

10. The antenna apparatus according to claim 6, wherein the radiating element includes a first radiating element and a second radiating element, a distance from a first side of the first radiating element to a second side of the second radiating element corresponds to one third of a wavelength of a frequency band used for radiating by the first radiating element and the second radiating element, and a third side of the second radiating element faces the first side, is opposite to the second side.

11. The antenna apparatus according to claim 1, wherein the radiating element comprises a conductive layer including a slot to radiate a signal or a radiating antenna.

12. A method of manufacturing an antenna apparatus, comprising:

preparing a first dielectric substrate including a first surface and a second surface opposite to the first surface;

forming a radiating element on the first surface or in the first dielectric substrate;

forming a first electrode on the second surface;

forming a first conductor provided from the first surface to the second surface, to connect electrically the radiating element and the first electrode;

preparing a second dielectric substrate including a third surface and a fourth surface opposite to the third surface;

forming a second electrode on the third surface;

forming a first signal line on the fourth surface or in the second dielectric substrate;

forming a second conductor provided from the third surface to the fourth surface, to connect electrically the second electrode and the first signal line; and adhering the second surface and the third surface with an adhesive layer.

13. The method according to claim 12, wherein the first electrode and the second electrode configure a capacitor, and the capacitor has capacitance corresponding to a frequency of a signal radiated by the radiating element.

14. The method according to claim 12, wherein the first dielectric substrate includes a first conductive plane on the second surface, the first electrode and the first conductive plane are formed from a first conductive layer on the second surface.

15. The method according to claim 12, wherein the second dielectric substrate includes a second conductive plane on the third surface, the second electrode and the second conductive plane are formed from a second conductive layer on the third surface.

16. The method according to claim 12, wherein at least one of the first conductor or the second conductor is formed as a through hole plated with metal or a through hole filled with a conductivity filler.

17. The method according to claim 12, further comprising forming a plurality of third conductors in the first dielectric substrate to surround the radiating element viewed from a through direction of the first dielectric substrate.

18. The method according to claim 17, wherein at least one of the third conductors is formed as a through hole plated with a metal or a through hole filled with a conductivity filler.

19. The method according to claim 12, wherein the forming the radiating element forms at least first and second radiating elements.

20. The method according to claim 12, wherein the forming the radiating element forms a conductive layer including a slot or a conductive layer as a radiating antenna.

* * * * *